United States Patent [19]

Holt et al.

[11] 4,175,810

[45] * Nov. 27, 1979

[54] ELECTRICAL INTERCONNECTION BOARDS WITH LEAD SOCKETS MOUNTED THEREIN AND METHOD FOR MAKING SAME

[75] Inventors: Richard C. Holt, Fairhaven, Mass.; Neil F. Damon, Manville, R.I.; Richard J. Hanlon, Attleboro, Mass.

[73] Assignee: AUGAT Inc., Attleboro, Mass.

[ * ] Notice: The portion of the term of this patent subsequent to Jun. 27, 1995, has been disclaimed.

[21] Appl. No.: 852,720

[22] Filed: Nov. 18, 1977

Related U.S. Application Data

[63] Continuation-in-part of Ser. No. 744,134, Nov. 22, 1976, Pat. No. 4,097,101.

[51] Int. Cl.[2] ..... H01R 13/40

[52] U.S. Cl. ..... 339/17 C; 339/220 R; 29/626

[58] Field of Search ..... 339/17 C, 17 LC, 220, 339/221, 275 B; 29/626, 630 D

[56] References Cited

U.S. PATENT DOCUMENTS

| | | | |
|---|---|---|---|
| 2,967,285 | 1/1961 | Freitas | 339/221 M |
| 3,187,298 | 6/1965 | Shannon | 339/258 R |
| 3,252,204 | 5/1966 | McFaddan | 29/626 |
| 3,409,864 | 11/1968 | Hoffman | 339/220 R |
| 3,784,965 | 1/1974 | Murphy | 339/258 R |
| 4,050,772 | 9/1977 | Birnholz et al. | 339/220 R |
| 4,097,101 | 6/1978 | Holt et al. | 339/17 C |

OTHER PUBLICATIONS

IBM Technical Disclosure Bulletin; vol. 14, No. 9, Feb. 1972.

*Primary Examiner*—Gerald A. Dost
*Attorney, Agent, or Firm*—Weingarten, Maxham & Schurgin

[57] ABSTRACT

An electrical interconnection board with lead sockets mounted in plated-through holes therein. The lead sockets are hollow cylindrical elements having a tapered entry opening at one end and a plurality of normally converging flexible fingers at the other end. The lead sockets are force fitted into the plated-through holes in the board with the receptacle end of the socket opening into the component side of the board. The invention is also concerned with the method for mounting lead sockets to electrical interconnection boards.

16 Claims, 10 Drawing Figures

ELECTRICAL INTERCONNECTION BOARDS WITH LEAD SOCKETS MOUNTED THEREIN AND METHOD FOR MAKING SAME

CROSS REFERENCE TO RELATED APPLICATION

This is a continuation-in-part of U.S. patent application Ser. No. 744,134 filed Nov. 22, 1976 now U.S. Pat. No. 4,097,101.

FIELD OF THE INVENTION

This invention relates generally to electrical interconnection means and more particularly concerns electrical interconnection boards such as printed circuit boards having lead sockets mounted in holes in the board.

DISCUSSION OF THE PRIOR ART

Electrical interconnection boards, typically referred to as printed circuit, printed wiring or panel boards, normally have mounted thereto a plurality of electronic components such as dual-in-line electronic packages which may be integrated circuit packages, or other types of electronic components formed with any number of leads. The boards are provided with holes and with either printed circuit paths or conductive voltage planes or both. In some prior art devices, leads of electronic components are inserted into plated-through holes, which holes are electrically connected to various printed circuit paths on one or both sides of the board. An electronic device lead would be inserted through one of the plated-through holes and would be individually soldered or collectively wave soldered so that the hole is filled with solder to permanently mount the component to the board and make positive electrical interconnection with the printed circuit paths. This method allows the lowest Z-plane profile available in the prior art, but in a fully soldered condition.

It is often desired to employ the concept of pluggability, that is, to be able to plug the leads of a component into a board for whatever purposes are desired and then to remove it and plug another component into the board. This, of course, is not possible with the previously discussed method of mounting components to the board because the component leads are soldered thereto. However, it is well known to provide two-part socket sleeve assemblies which are mounted in non-plated-through holes in panel boards wherein one end of the sleeve has a lead receiving socket and the other end normally provides a solder tail or a wire wrapping pin. See, for example, U.S. Pat. No. 3,784,965. The solder tail and wire wrapping pins project for some appreciable distance beyond the non-component side of the board and the lead receiving socket end of the sleeve normally projects a short distance beyond the other side of the board. The sleeve socket end is necessarily somewhat larger than might otherwise be desired because of the requirement that there be a tapered opening to facilitate inserting component leads and that there be a contact insert within the socket assembly device itself to frictionally engage the lead. Thus it is necessary that the socket end of the sleeve project beyond the board surface in order to provide the desired opening which is larger than the hole through the board. When such a socket assembly with a contact insert is used, pluggability is available but at a relatively high cost because of the necessity for using the two-element socket assembly described above which not only is expensive to manufacture but the two elements must be combined before inserting into holes in the board. Also the Z-plane dimension, or overall thickness of the board with components and interconnecting projecting pins, is appreciable, substantially greater than with direct soldering as described above.

A third commonly used alternative which permits pluggability is an insulative socket with contacts mounted thereon. These contacts have extending pins to engage the holes in the board and have sockets to receive the leads of the component. The extending pins are normally soldered to the board. Such sockets have typically been of dual-in-line (DIL) configuration, represented by U.S. Pat. No. 3,989,331 and No. Des. 210,829. Such installations add the thickness of the insulative socket to the component thickness to nearly double the Z-plane dimension of the board with mounted components.

SUMMARY OF THE INVENTION

It is an object of the present invention to provide pluggability of electronic components into interconnection boards at a substantially reduced cost while at the same time achieving a Z-plane dimension no greater than with direct soldering. The result of thickness reduction is improved stacking density because each board may thereby be placed closer to the adjacent facing board.

Cost reduction is attributable to several factors. With respect to the two-part socket sleeve assembly which allows pluggability in non-plated-through holes, the outer sleeve is eliminated. Such a sleeve is a tiny machined part, typically of brass, gold over nickel plated. The lead socket is made of similar materials and similar manufacturing steps are employed. The sleeve and lead socket then must be assembled and mounted in a hole in the board. Where the insulative socket is used, the sleeve and lead socket have to be assembled thereto. In addition to eliminating the sleeve and its manufacturing steps, as well as the insulative socket, the cost of soldering is also eliminated. As stated previously, direct mounting of component leads to plated-through holes necessarily involves soldering for physical and electrical connection, and pluggability is not possible. Two-part socket sleeve assemblies are inserted into non-plated-through holes and soldering is necessary for electrical connection to board circuitry. Likewise, the projecting pins of insulative sockets must be soldered to the board for electrical and physical connection to permit pluggability of a component with respect to the insulative socket.

Non-compliant lead sockets which are similar to those used in the sleeves of the two-part socket assemblies described above, are force fitted into plated-through holes in an electrical interconnection board in such a manner that they are retained therein and are adapted to receive and removably retain the leads of electronic components, including dual-in-line electronic packages. While these lead sockets retain the leads of the electronic components, they also permit the leads to be readily removed when desired, and replaced by other components whose leads are then inserted into the same lead sockets mounted in the board.

Several alternative constructions of the lead sockets are provided, showing somewhat different means by which the lead socket is permanently retained in the hole in the board. These embodiments include knurled surfaces, inwardly projecting grooves and outwardly projecting ridges. One method for mounting the lead socket to the board includes a tool having a male pin adapted to hold the lead socket. The tool is formed with a tapered surface above the pin which, when forced into the board, mounts the lead socket thereto and forms a countersunk hole in the top portion of the hole in the board. This countersunk hole thereby provides a sufficiently tapered lead-in to facilitate insertion of the component leads into the holes and thereeupon into the lead sockets.

BRIEF DESCRIPTION OF THE DRAWING

The advantages, features and objects of this invention will be more clearly understood from the following detailed description when taken in conjunction with the accompanying drawing in which.

DETAILED DESCRIPTION OF THE PREFERRED EMBODIMENTS

Figure 1:
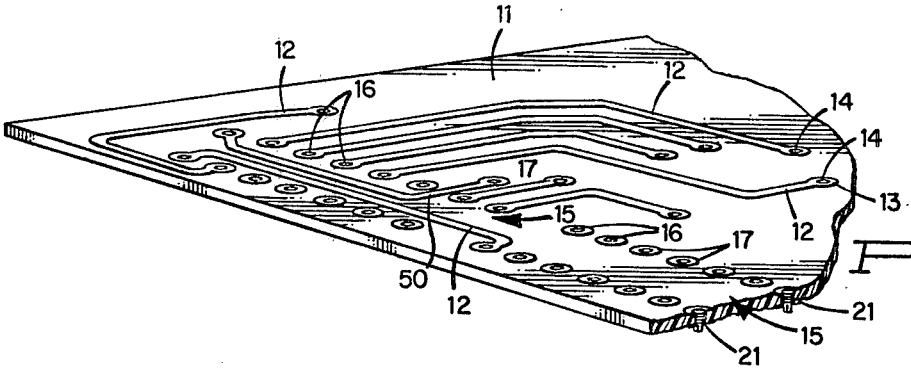
FIG. 1 is a perspective view of a portion of a printed circuit board having lead sockets inserted in holes therein in accordance with this invention.

WIth reference now to the drawing and more particularly to FIG. 1 thereof, there is shown a portion of a printed circuit board 11 having paths 12 of electrically conductive material on one side thereof, each of paths 12 terminating in a contact pad 13 of electrically conductive material surrounding a hole 14. Holes 14 are plated-through, having a conductive copper base and conductive solder coating thereover in conventional manner. FIG. 1 shows several individual plated-through holes 14 at the ends of conductive paths 12, and two dual-in-line arrays 15 of holes 16 having contact pads 17 electrically connected to the plating in holes 16. In each hole 16 is a lead socket 21 representing any of the various embodiments of the lead sockets shown and described herein.

Figure 2:
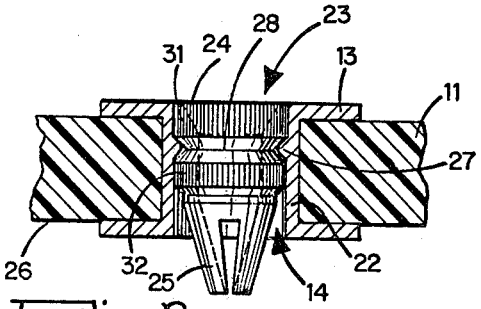
FIG. 2 is a fragmentary enlarged sectional view through a plated-through hole in the board of FIG. 1 showing a preferred embodiment of a lead socket of this invention mounted in the hole.

With reference now to FIG. 2 there is shown in enlarged cross-section a single plated-through hole 14 having a contact pad 13 and plating 22 on the inside surfaces of the hole. Mounted in the hole is a lead socket 23 shown with a tapered entry opening 24 at the top and normally converging flexible fingers 25 at the other end projecting somewhat beyond the bottom side 26 of board 11. The amount of projection beyond the board surface depends not only upon the board thickness but upon the length of the lead socket. In some instances the flexible fingers may be completely within the plated-through hole. Lead socket 23 is force fitted into the plating 22 in hole 14. Annual groove 28 in the cylindrical body portion of the lead socket receives some of the metal 27 which is radially displaced due to the force fit, thereby assisting in firmly longitudinally anchoring the lead socket in the hole. This displacement of hole plating material occurs because the lead socket is non-compliant relative to the solder surface in the hole. Because of the conical taper from the flexible fingers to the cylindrical body portion of the lead socket, radial forces transmitted from the socket to the hole plating are evenly distributed throughout the circumference thereof. The combination of the compliance of the board, which is typically made of epoxy fiberglass and is placed in tension upon entry of the lead socket, and the metal plating in the hole, permits the slight radial displacement necessary to allow entry of the lead socket. Annular groove 28, which is, in effect, a relief area, permits some of the radially displaced metal to flow back toward the axis of the hole, thereby locking the socket in place after the force fit entry. Thus, contrary to conventional contacts mounted to circuit boards, the lead socket of this invention is the female part of the locking structure and the hole plating provides the male portion thereof. While the hole and the copper lining are displaced radially, the solder plating the copper is partially displaced radially and partially longitudinally as will be further discussed herein below. Cylindrical surfaces 31 and 32 of the lead socket are shown as being knurled or slotted to facilitate firm rotational engagement with the metal 22 of the plated-through hole. However, such surface treatment is not necessary to proper functioning of the invention.

It should be noted that in the drawing the thickness of the plating in the holes and the contact pads surrounding holes are exaggerated for purposes of clarity. Dimensions are given as examples only. A conventional printed circuit board as shown in the drawing may be 0.062 inch (1.575 mm) thick while the metal portion 13 is approximately 0.0035 inch (0.0889 mm) thick, and metal portion 22 is approximately 0.0015 inch (0.038 mm) thick, both being a combination of copper and solder. Although only one metal is indicated, normally the base metal is copper and it is coated with tin lead (solder), the latter having significantly more resiliency than the copper.

Figure 3:
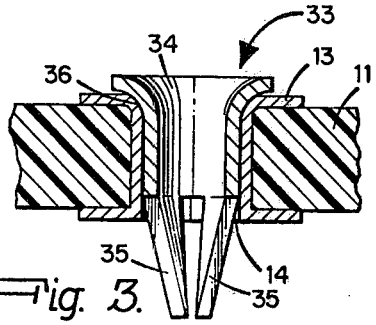
FIG. 3 is a view similar to FIG. 2 of another embodiment of a lead socket mounted to the board of FIG. 1.

FIG. 3 shows a modified embodiment of the invention wherein lead socket 33 is flared at its socket opening to form a flange 34 which facilitates entry of a component lead into the opening. As with each of the lead sockets described herein, the lead is firmly held in place between normally converging fingers 35 at the other end of the lead socket. Lead socket 33 may be retained in hole 14 by means of any of the cylindrical surface configurations shown herein. When lead socket 33 is forced into hole 14, some of the plating 36 contacted by the outside of the rounded top of the lead socket is displaced as shown in the drawing.

Figure 4:
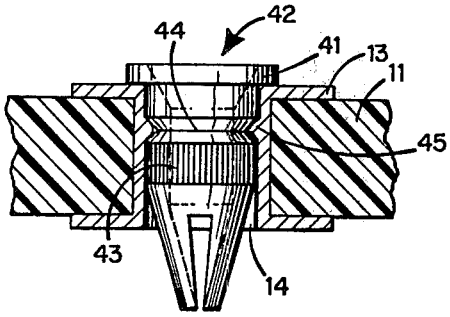
FIG. 4 is a view similar to FIG. 2 of still another embodiment of a lead socket mounted to the board of FIG. 1.

The embodiment of FIG. 4 is somewhat similar to that of FIG. 2 except that a flange or shoulder 41 is provided on top of lead socket 42 to provide a positive stop for the insertion machinery when the lead socket is forced into hole 14. Knurling or grooves 43 are shown on the cylindrical body portion of the lead socket and annular V-shaped groove 44 is provided to receive displaced plating material 45 for better axial and rotational anchoring, in the manner shown in FIG. 2.

Figure 5:
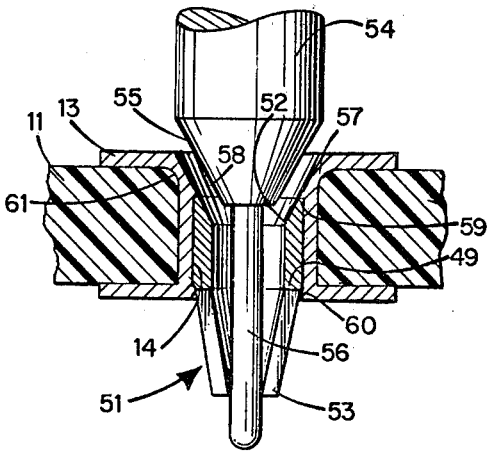
FIG. 5 is a view similar to FIG. 2 of yet another embodiment of a lead socket mounted to the board of FIG. 1 and showing the tool for mounting the lead socket.

FIG. 5 shows a lead socket 51, having a tapered opening 52 and normally converging fingers 53, which has been inserted into hole 14 by means of a tool 54 having a tapered surface 55 and a projecting pin 56. Pin 56 is substantially similar in size to a lead of an electronic component and may be used to pick up and hold lead socket 51 by being inserted through tapered opening 52 and between fingers 53 which frictionally engage pin 56. Tool 54 then proceeds downwardly to insert lead socket 51 into hole 14 and continues downward to, in effect, countersink hole 14 and push the top of lead socket 51 below the top surface of board 11 by approximately 0.005–0.010 inch (0.0127–0.254 mm), or about 10% of the depth of the hole, that is, just slightly below the top surface surrounding the hole. Tapered surface 55 on tool 54 is chosen to match the slope of tapered opening 52 so that the displaced plating material 57 forms a continuation of lead socket opening 52 and effectively provides a tapered lead-in for the lead of an electrical component. Some of the plating material 58 tends to flow over the annular top surface 59 of the lead socket, thereby providing a smooth tapered opening into the socket. In this manner, the top of the opening is somewhat larger than either hole 14 or the opening in lead socket 51 but by displacing electrically conductive plating material 57 and, to some extent, displacing some of the electrically insulating material 61 of board 11, the hole is formed as desired while the electrical integrity of the plating is maintained. Note that there is a build-up of plating material 60 at bend 49 of the socket due to the interference fit when the socket is inserted wherein plating material is caused to flow longitudinally. In this particular embodiment, plating material 60 builds up in such a position that it tends to urge fingers 53 together. In order to prevent them from being too tight for insertion of an IC lead, pin 56 extends between the distal ends of the fingers during insertion into hole 14, thereby prestressing them to the desired amount of bias to frictionally receive an IC lead. However, material 60 continues to act as a reinforcement at bend 49 thereby making the spring action of the fingers somewhat stronger than they would be before insertion. Any desired means may be used to inhibit longitudinal and rotational movement of socket 51 in hole 14 as described in connection with other embodiments shown and described therein.

Alternatively to placing lead socket 51 in hole 14 by means of tool 54, the sockets could be initially placed in the holes by hand or a large number could be initially inserted substantially simultaneously by vibrating the pre-drilled board with a large number of lead sockets dispersed over the surface thereof. Since the top of each lead socket is too large to enter a hole in the board, they will ultimately enter the holes with the proper orientation, that is, with the converging fingers in the hole. Additionally, the lead sockets are configured so that the cylindrical body portion is only about $\frac{1}{3}$ of the socket length and the tapered fingers account for about $\frac{2}{3}$ of the length. Thus the balance point of the socket is such when it moves over the surface of a board with holes therein, the heavier tapered end will naturally enter the holes. This socket configuration facilitates simultaneous final seating of all of the sockets in a board by means of a flat platen without the need for individual guidance or the risk of damage to the plated-through holes. Alternatively tool 54 may then be used, individually or in a ganged arrangement, to set the sockets and provide the tapered entry as shown in FIG. 5. This method may be a particularly useful embodiment of this invention in some situations because it permits the hole itself to provide the desired lead-in taper. Circuit density may also be increased because as many as two fine circuit paths 50 (FIG. 1) may be placed between adjacent plated-through holes in a dual-in-line array. Also the diameter of conductive material used for making the pads 13 may be reduced and in some instances completely eliminated when the lead socket of this invention is used.

Figure 6:
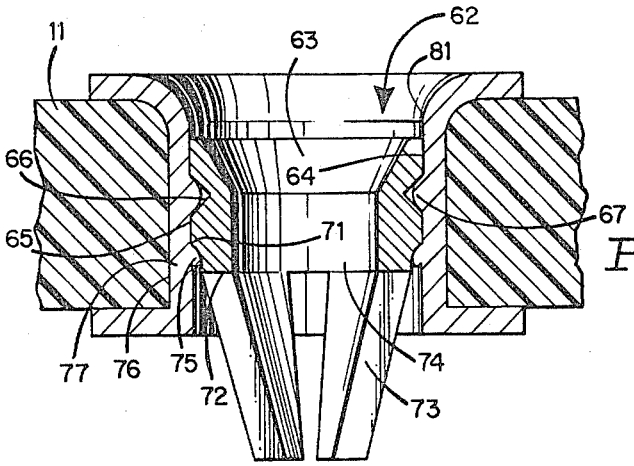
FIG. 6 is a view on an enlarged scale similar to FIG. 2 of another alternative embodiment of the lead socket mounted to the board of FIG. 1.

FIG. 6 discloses an additional embodiment of the invention wherein lead socket 62 with tapered opening 63 is formed with a cylindrical body portion comprised of annular collars 64 and 65 longitudinally separated by a circumferential groove 66 with plating material 67 partially filling the groove. The groove is shown V-shaped but may have any appropriate shape. The cylindrical outer surfaces of either or both collars 64 and 65 may be knurled or otherwise roughened if desired, in the manner of the lead sockets of FIGS. 2 and 4, but such additional surface treatment is not necessary. The lower termination 71 of collar 65 is longitudinally spaced a short distance from the bend 72 where fingers 73 angle inwardly from the body 74 of the socket toward the longitudinal axis thereof. This provides a relief area to permit a build-up of plating material 75, which occurs when socket 62 is forced into hole 76 in board 11 with plating 77 lining the hole, without affecting the spring characteristics of fingers 73 at bend 72.

Figure 7:
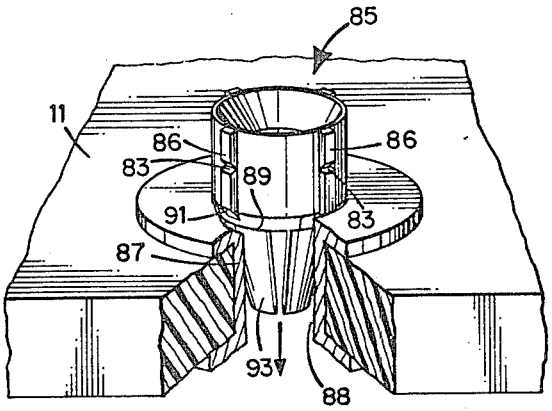
FIG. 7 is a perspective view of still another alternative embodiment of the lead socket of this invention showing the lead socket before being seated on the board.

In FIG. 7 there is shown a modified lead socket 85 having a plurality of radially projecting splines 86 which provide the interference fit with plating 87 in hole 88 in board 11. These splines 86 may be formed with a circumferential groove 83 similar to groove 66 in FIG. 6 or not as desired. Splines 86 extend down the side of socket 85 for a distance similar to the longitudinal length of collars 64 and 65 of socket 62 in FIG. 6. That is, bend 89 where fingers 93 commence converging is below the bottom termination 91 of splines 86. These radially projecting splines are partially to prevent angular motion of the lead socket in the hole with respect to the longitudinal axis and partially to account for tolerances in hole sizes which can vary relatively widely in plated-through holes.

While lead socket 85 functions in a manner similar to socket 62 in FIG. 6 as to plating displacement, less plating is displaced because there is an interference fit only where splines 86 contact the plating in the hole. A particular advantage of the FIG. 7 embodiment is that less insertion force is necessary to mount the lead socket to the plated-through hole in the board. An additional advantage is that lead socket 85 can accommodate relatively wide variations in plated-through hole sizes.

Figure 8:
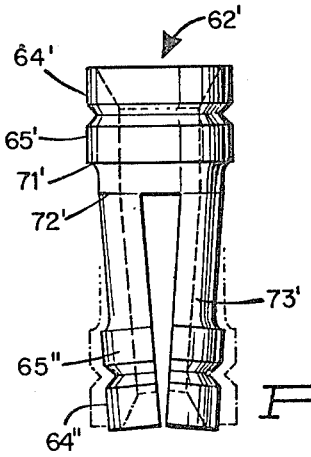
FIG. 8 shows the lead socket of FIG. 6 in an alternative form designed to facilitate manufacturing thereof.

The lead socket 62 of FIG. 6 is shown in somewhat modified form in FIG. 8 as lead socket 62' with similar projections 64'' and 65'' on the distal ends of fingers 73'. This is for purposes of manufacturing convenience and collars 64'' and 65'' have no other function when lead socket 62' is mounted in a hole in a board. The blank is formed from tubing, inwardly beveled at both ends and a portion of the thickness of the wall is removed between projections 65' and 65'' before material is radially milled out forming fingers 73'. It has been found to be more efficient to form the lead socket blank with the same internal taper on each end so that orientation of the socket, which is only about 0.1 inch (2.54 mm) long, is not necessary until all machining and other forming has been completed. While the other embodiments are shown with the outer surfaces of the resilient fingers smooth, it is likely that they would all be made the same way and whatever annular projections are at the top would also appear at the distal ends of the fingers as in FIG. 8.

FIG. 9 shows a preferred embodiment of the present lead socket 101 and corresponding plated-through hole 102 in board 103. Note that there is no contact pad whatever extending radially from the ends of the hole over the board surfaces. It has been found that such pads are unnecessary for proper function of the inventions. Of course, the plating will often be interconnected with a circuit path on the board surface. In conventional electrical inter-connection boards where soldering is necessary, contact pads as shown in FIG. 7 are employed for several reasons. They provide a base for the solder fillet and provide retention of the plated through hole in the board. When a lead is soldered to such a hole, either vibration or tension on the lead could pull the plating from the hole without the pads on either end.

The present invention does not need such pads, primarily because soldering is not required. Thus there is no need for a base for the solder fillet and there is no significant possibility of a pluggable lead retained by the socket fingers being able to tear out the plated hole. As explained above, the force fit together with radial displacement of the hole and plating locks the lead socket and the plating in the hole.

Figure 9A:
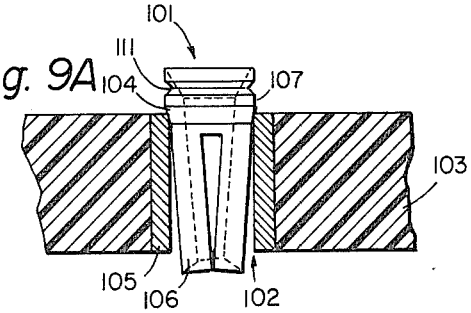
FIG. 9A is a sectional view of a preferred embodiment of a lead socket according to the invention at the initial stage of insertion into a plated-through hole.

As shown in FIG. 9A, the interference between the socket 101 and the hole plating 105 normally first occurs at tapered area 104 which is a relief area equivalent to that shown in the embodiment of FIG. 6 and provides a transition between fingers 106 and cylindrical portion 107. Upon entry of the socket, the hole plating is radially expanded rather than pushed longitudinally, thus not only providing for locking of the socket in the hole but firmly engaging the plating with the board surrounding it.

Figure 9B:
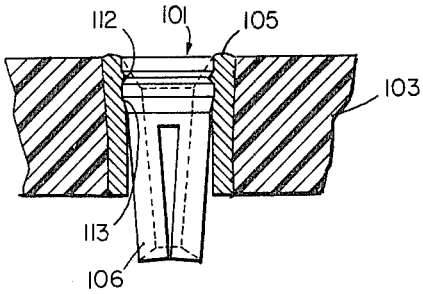
FIG. 9B is a sectional view similar to FIG. 9A showing the lead socket fully seated.

The external surface of the cylindrical body portion 107 is smooth and has a circumferential groove 111 spaced from either end of the cylinder. As shown in FIG. 9B, when the socket is fully seated with its top surface flush with the top of the board, displaced plating material 112 partially fills the groove. Because of both the radial and longitudinal displacement of the plating material, the top portion of the plating wall is somewhat thinner than the bottom portion which has not been subjected to the force fit. Also, because of compression of the board material, the plating material at the top of the hole has a somewhat greater diameter than the bottom. Both this spreading and the thinning of the top portion of the plating are shown exaggerated in FIG. 9B. Similar to the embodiment of FIG. 6, longitudinally displaced plating material 113 gathers below cylinder 107 about relief area 104, clear of fingers 106.

Although the socket is shown mounted flush with the top surface of the board in FIG. 9B, it may be desired to recess the socket below the board surface so that the countersink or tapered entry of the socket is below the board surface and facilitates entry of the component lead.

The fiberglass, copper and solder constituting the hole wall has a physical memory and recovers to some extent upon removal of a socket. It has thus been found possible to replace sockets when necessary without significant damage to the hole plating and still retain the advantages of this invention.

The lead sockets used in this invention may be made by any practical process, such as machining, stamping and rolling, among others. They may be relatively conventional elements or may be formed especially for use in this invention. The primary requirement is that the lead sockets be substantially non-compliant, that they be seated firmly in the holes in the board by means of an interference fit and that they frictionally engage the dual-in-line package (DIP) leads. However the individual lead sockets can be removed or replaced as required.

The advantages of the present invention over the prior art may now be readily appreciated. The leads of electronic components, including DIP's, remain pluggable so that they can be removed or replaced at any time, while the profile of the board with DIP's is the same as a board with the DIP's soldered directly into plated-through holes, that is, in a permanent, unpluggable condition. These lead sockets are configured to be shorter than the electrical component lead length so that it does not add to the height of either the board or the component. With this invention it is now possible to mount components such as DIP's to both sides of a printed circuit board. The lead sockets could be oriented in one direction for certain holes or arrays of holes, and inserted from the other side for other hole arrays. This permits a staggered arrangement of DIP's with respect to the opposite sides of the board, and the ability to use multiple very fine circuit paths between adjacent plated-through holes provides for the necessary electrical interconnection resulting in a very dense board. Another advantage is that because the lead sockets are axially open, air flow through the board is permitted, which is not possible with closed end sockets or soldered configurations. Where boards are cooled by an air stream over their surfaces, tests have shown that this invention allows lower operating temperatures for the components. As an actual example, at 100 ma power input to a DIP, that device mounted on a board made according to the invention operated at 11° C. cooler than on boards without the flow through capability. Additionally, the axial open aspect allows multiple stacking of boards with feed-through pins. Alternatively, leads on pins may extend well beyond the bottom of the board for additional electrical interconnection such as by wire wrapping.

In order to fully appreciate the value of the present invention, it should be noted that wave soldering operations, which are not necessary when employing the present invention, involve some or all of the following: (a) lead clinching; (b) board pre-bake; (c) post cleaning; (d) gold contact masking before wave soldering; (e) blow holes and various solder joint defects requiring expensive touch-up operations; (f) cracked solder joints during board service life; (g) inspection necessary after soldering; (h) damage to heat sensitive components; (i) board warpage; (j) special soldering fixtures; (k) solder masks; (l) flux residues and entrapments; and (m) costly soldering equipment and maintenance. Additionally, this invention provides field replacement with total pluggability of all components including discrete components. It maintains the lowest possible board profile and permits open access on the non-component or bottom side of the board for maximum inspectability. Furthermore, the density of a printed circuit board can be increased through the use of this invention by reducing pad diameters such as pads 13 needed for solder joint construction.

For high vibration uses soldering or lead clinching may be applied to the bottom side of the board to permanently connect certain selected leads of a component, such as at the corners of a DIP. Such soldering or clinching can be done individually and the need therefor would be relatively seldom. Removal of such soldered DIP's is also easily accomplished by simply desoldering or unclinching only a few points.

In view of the above description, it is likely that modifications and improvements will occur to those skilled in the art which are within the scope of this invention.

What is claimed is:

1. An electrical interconnection device comprising:

a flat generally rectangular sheet of electrically insulative compliant material;

electrically conductive material secured in discrete areas on at least one side of said sheet, said sheet having a multiplicity of holes therethrough, at least some of said holes normally intercepting at least some of said areas of electrically conductive material;

electrically conductive plating material on the inside surfaces of at least some of said holes thereby forming plated-through holes, said plating material being electrically interconnected with said respective intercepted discrete areas of electrically conductive material;

a lead socket formed with a substantially non-compliant cylindrical body portion having a circumferential groove therein intermediate the ends of said body portion, an axial opening through said lead socket, a plurality of flexible fingers normally converging toward one another at one end of said body portion and a tapered entry opening at the other end, one of said lead sockets being mounted in each of at least some of said plated-through holes, said body portion having an external diameter larger than the internal diameter of said plated-through holes thereby forming an interference fit therewith, some of said plating material in said plated-through holes, which material is relatively compliant with respect to said body portion, being radially displacd by said body portion upon insertion thereof and partially filling said circumferential groove when said lead socket is fully seated with said groove positioned within said hole;

whereby said tapered entry is adapted to receive an electronic component lead, said fingers are adapted to frictionally engage said lead as it projects through said lead socket, and air flow is permitted through said lead socket.

2. The device recited in claim 1 wherein the top of said lead socket surrounding said tapered entry is in the same plane as said electrically conductive material on said sheet.

3. The device recited in claim 1 wherein the top of said lead socket surrounding said tapered opening is below the surface of said electrically conductive material on said sheet.

4. The device recited in claim 1 wherein said body portion comprises substantially one-third of the length of said lead socket and said flexible fingers comprise the remaining two-thirds, the mass distribution thus resulting thereby facilitating automatic insertion of said lead sockets into said plated-through holes.

5. The device recited in claim 1 wherein said lead socket is further formed with a conical transitional surface between said flexible fingers and said cylindrical body portion, said surface facilitating the radial displacement of said plating material.

6. The device recited in claim 5 wherein said conical surface provides a relief area for longitudinally displaced plating material to gather free of said flexible fingers.

7. The device recited in claim 1 wherein the outside cylindrical surface of said body portion of said lead socket is formed with a plurality of longitudinal radially projecting splines, said circumferential groove passing through said splines and having a depth substantially equal to the radial thickness of said splines.

8. The device recited in claim 1 wherein the top of said lead socket surrounding said tapered entry is flared outwardly thereby displacing some of said plating material when said lead socket is inserted into one of said holes.

9. The device recited in claim 1 wherein said cylinder with said circumferential groove forms two cylindrical collars on the body portion of said lead socket.

10. The device recited in claim 1 wherein the top of said lead socket surrounding said tapered entry is above the surface of said electrically conductive material on said sheet.

11. The device recited in claim 1 wherein said cylindrical body portion is approximately one-third of the length of said lead socket.

12. A method for making an electrical interconnection device comprising a flat generally rectangular sheet of electrically insulative compliant material having electrically conductive material secured in discrete areas on at least one side thereof, said method comprising the steps of:

boring a multiplicity of holes through said sheet, at least some of said holes individually intercepting at least some of said areas of electrically conductive material;

plating at least some of said holes with electrically conductive material to form plated-through holes, said plating material being electrically connected to said intercepted conductive areas;

inserting a lead socket into each of at least some of said plated-through holes, said lead socket having a cylindrical body portion with a circumferential groove in its surface intermediate its ends, said body portion being larger than said plated-through holes thereby forming an interference fit therewith, said body portion being non-compliant with respect to said plating material and said sheet, said lead socket being further formed with a tapered entry at one end thereof; and radially displacing some of said plating material in said plated-through holes by insertion of said lead socket therein, said plating material flowing into and partially filling said circumferential groove when said lead socket is fully seated with said groove positioned within said hole;

whereby said lead socket in said sheet is adapted to receive and frictionally retain an electronic component lead.

13. The method recited in claim 12 wherein said inserting step proceeds until the top of said lead socket surrounding said tapered entry is substantially coplanar with the surface of said electrically conductive material secured to said sheet.

14. The method recited in claim 12 wherein said inserting step proceeds until the top of said lead socket surrounding said tapered entry is below the surface of said sheet.

15. An electrical interconnection device comprising:

a flat generally rectangular sheet of electrical insulative compliant material;

electrically conductive material secured in discrete areas on at least one side of said sheet, said sheet having a multiplicity of holes therethrough, at least some of said holes normally intercepting at least some of said areas of electrically conductive material;

electrically conductive plating material on the inside surfaces of at least some of said holes thereby forming plated-through holes, said plating material being electrically interconnected with said respective intercepted discrete areas of electrically conductive material;

a lead socket formed with a substantially non-compliant cylindrical body portion having a circumferential groove therein intermediate the ends of said body portion, an axial opening through said lead socket, a plurality of flexible fingers normally converging toward one another at one end of said body portion and a tapered entry opening at the other end, one of said lead sockets being mounted with said circumferential groove of said body portion within each of at least some of said plated-through holes, said body portion having an external diameter larger than the internal diameter of said plated-through holes thereby forming an interference fit therewith, some of said plating material in said plated-through holes, which material, together with the material of said sheet in contact with said plating material, is relatively compliant with respect to said body portion, being radially displaced by said transition surface upon insertion thereof and, due to said compliance, partially filling said circumferential groove when said lead socket is fully seated with said groove positioned within said hole;

whereby said tapered entry is adapted to receive an electronic component lead, said fingers are adapted to frictionally engage said lead as it projects through said lead socket, and air flow is permitted through said lead socket.

16. An electrical interconnection device comprising:

a flat generally rectangular sheet of electrically insulative compliant material;

electrically conductive material secured in discrete areas on at least one side of said sheet, said sheet having a multiplicity of holes therethrough, at least some of said holes normally intercepting at least some of said areas of electrically conductive material;

electrically conductive plating material on the inside surfaces of at least some of said holes thereby forming plated-through holes, said plating material being electrically interconnected with said respective intercepted discrete areas of electrically conductive material;

a lead socket formed with a substantially non-compliant cylindrical body portion having a circumferential groove therein intermediate the ends of said body portion, an axial opening through said lead socket, a plurality of flexible fingers normally converging toward one another at one end of said body portion and a tapered entry opening at the other end, said fingers converging from a bend point at the lower end of said body portion of said lead socket, one of said lead sockets being mounted with said circumferential groove of said body portion within each of at least some of said plated-through holes, said body portion having an external diameter larger than the internal diameter of said plated-through holes thereby forming an interference fit therewith, some of said plating material in said plated-through holes, which material, together with the material of said sheet in contact with said plating material, is relatively compliant with respect to said body portion, being radially displaced by said body portion upon insertion thereof and, due to said compliance, partially filling said circumferential groove when said lead socket is fully seated with said groove positioned within said hole, said bend being normally within said plated-through hole and being longitudinally spaced from that portion of said body portion in interference fit with said plating material by a relief area, some of said plating material gathering around said relief area free from said bend;

whereby said tapered entry is adapted to receive an electronic component lead, said fingers are adapted to frictionally engage said lead as it projects through said lead socket, and air flow is permitted through said lead socket.

* * * * *